United States Patent [19]

Morris

[11] 4,334,935

[45] Jun. 15, 1982

[54] PRODUCTION OF ALUMINUM ALLOY SHEET

[75] Inventor: Larry R. Morris, Yarker, Canada

[73] Assignee: Alcan Research and Development Limited, Montreal, Quebec, Canada

[21] Appl. No.: 144,438

[22] Filed: Apr. 28, 1980

[51] Int. Cl.[3] ..... C22F 1/04

[52] U.S. Cl. ..... 148/2; 148/11.5 A; 148/415; 148/416

[58] Field of Search ..... 148/2, 11.5 A, 32

[56] References Cited

U.S. PATENT DOCUMENTS 3,930,895 1/1976 Moser et al. ..... 148/2

4,111,721 9/1978 Hitchler et al. ..... 148/2

FOREIGN PATENT DOCUMENTS 2011946 7/1979 United Kingdom .

*Primary Examiner*—R. Dean

*Attorney, Agent, or Firm*—Cooper, Dunham, Clark, Griffin & Moran

[57] ABSTRACT

Fine-grained, formable Al-Mn alloy sheet is produced from strip-cast slab (e.g. twin-roll-cast slab) by including 1.3–2.3% Mn in the alloy, slab annealing the workpiece by heating it to precipitate most of the Mn in fine intermetallic particles, cold rolling the workpiece to sheet of final gauge with an interanneal performed (between successive cold rolling stages) under nonrecrystallizing conditions to reduce the amount of Mn present in solid solution in the aluminum matrix, and annealing the final sheet.

9 Claims, 1 Drawing Figure

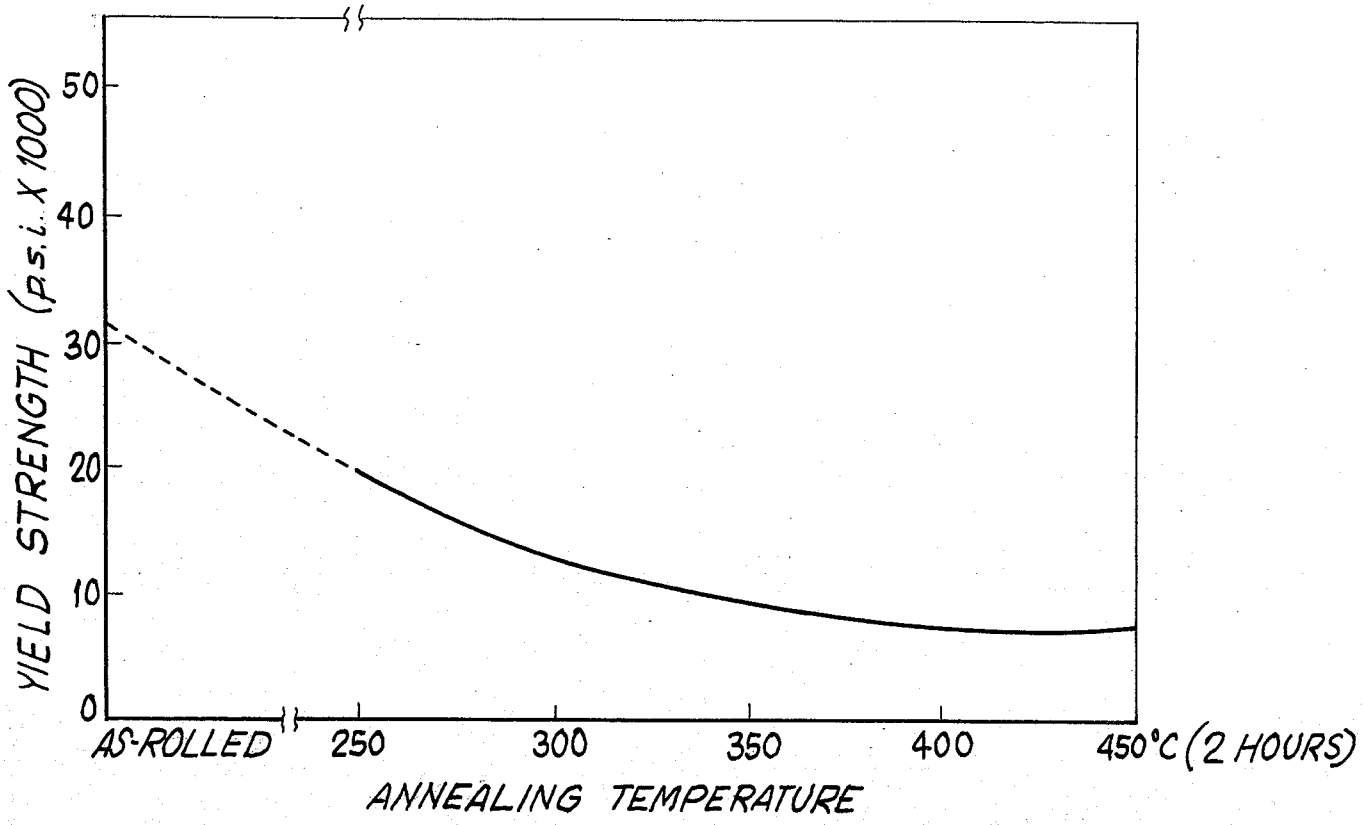
YIELD STRENGTH (p.s.i. X 1000)
50
40
30
20
10
0
AS-ROLLED
250
300
350
400
450°C (2 HOURS)
ANNEALING TEMPERATURE

PRODUCTION OF ALUMINUM ALLOY SHEET

DESCRIPTION

Background of the Invention

This invention relates to processes for producing aluminum alloy sheet from strip-cast slab, and to the products of such processes. The term "sheet" herein will be used generically to refer to those gauges which are commonly designated foil as well as to those customarily considered sheet.

As herein contemplated, strip casting is the continuous casting of an aluminum alloy slab having a thickness of not more than about 25 mm., and often substantially less. Various strip casting techniques are known; one such known technique, to which detailed reference will be made herein for purposes of illustration, involves the use of twin-roll type casters, such as the continuous strip casters manufactured by Hunter Engineering Company of Riverside, California. In a twin-roll caster, the molten metal is solidified in the nip of a pair of heavily chilled steel rolls, which draw the molten metal out of an insulated injector nozzle in close proximity to the rolls, the cast material being in the form of a slab e.g. in a thickness range of 5–10 mm. and being typically cast at a speed of 60–200 cm./min. The metal is essentially fully solidified when it passes the center line of the caster rolls; it is subjected to heavy compression and some plastic deformation as it passes through the gap between the rolls, with the consequence that its surfaces are in excellent heat exchange contact with the caster rolls.

The production of aluminum alloy sheet from strip-cast slab has various advantages, frequently and significantly including savings of cost. Heretofore, however, it has not been possible to achieve fine-grained formable sheet from strip-cast slab of Al-Mn alloys such as the commercial alloy identified by Aluminum Association designation AA 3003, owing (as at present believed) to uncontrolled precipitation of Mn-rich particles and resultant preferential growth of relatively few large grains. Thus, in making products such as foil e.g. for rigid foil containers, it has been necessary to employ metal conventionally cast in thick direct-chilled (D.C.) ingots and successively hot-rolled and cold-rolled, notwithstanding that use of Al-Mn alloy sheet from strip-cast slab would often be economically beneficial if an adequate combination of strength and formability could be attained. It would accordingly be desirable to provide such sheet, i.e. produced from strip-cast slab, characterized by an improved combination of properties of strength and formability.

SUMMARY OF THE INVENTION

The present invention broadly contemplates the provision of a process for producing aluminum alloy sheet, comprising the successive steps of strip-casting a workpiece in the form of a slab not more than about 25 mm. thick, of an alloy consisting essentially of 1.3–2.3% manganese, up to 0.5% each of iron, magnesium, and copper, up to 0.3% silicon, up to 2.0% zinc, less than 0.1% each of zirconium, chromium, and titanium, other elements up to 0.3% each and up to 1.0% total, balance aluminum (all percentages herein being expressed by weight unless otherwise specified); heating (i.e. slab annealing) the workpiece at a temperature of between about 450° and about 550° C., prior to any cold working; initially reducing the thickness of the slab-annealed workpiece by cold rolling; interannealing the workpiece by heating at a temperature, between about 250° and about 450° C., under conditions such that the workpiece remains substantially free of recrystallization; cold rolling the workpiece again to achieve a sheet having a desired final sheet gauge; and subjecting the sheet to a partial or full final anneal. Further, the invention embraces the product of the described process. In this process, the heating or slab annealing of the workpiece is performed as a step for precipitating at least a major proportion (more than 50%) of the manganese in the slab in Mn-rich intermetallic particles having an average particle size between about 0.1 and about two microns, without effecting coarsening or agglomeration of the precipitate to a degree that would increase the average particle size above about two microns; if the workpiece is subjected to any hot rolling, i.e. after casting, the slab annealing step is performed after the hot rolling is completed. The interannealing is performed, as a step for reducing the amount of manganese in solid solution in the aluminum matrix to not more than about 0.2% of the matrix, under conditions of time and temperature mutually selected to effect that result while maintaining the workpiece at least substantially free of recrystallization by which is meant that the workpiece after interannealing (and before further cold rolling) contains not more than about 20% by volume of recrystallized grains. Such conditions will be referred to herein as nonrecrystallizing conditions.

Owing, as believed, to the above-described combination of composition features (particularly including the specified manganese content) and heat treatment including the steps of slab annealing and (after cold reduction following the slab anneal) interannealing without substantial recrystallization, the sheet product of the invention is characterized by a fine grain or subgrain structure with intermetallic particles having an average particle size between about 0.1 and about two microns, and by a yield strength curve (plotted against final annealing temperature) having a shallow slope over the annealing temperature range of interest (about 250°–400° C.). This shallow slope is advantageous from the standpoint of reproducibility of results, in that small variations in annealing time and/or temperature do not give widely different properties. In particular, the process of the invention enables production, from strip-cast (e.g. twin-roll-cast) slab, of Al-Mn alloy sheet exhibiting a combination of properties of strength and formability (as represented by percent elongation) at least about equivalent to sheet of alloys such as AA 3003 produced conventionally from thick D.C. ingot by successive hot- and cold-rolling steps. This sheet is advantageously suitable for making rigid foil containers and for other purposes. Alternatively, the present process can be used to produce sheet having strength superior to the aforementioned sheet made from conventional D.C. ingot, with little sacrifice of formability. In addition, the workpiece after the interannealing step (i.e. without performance of the subsequent cold rolling and final annealing steps of the complete process of the invention) is itself a useful sheet product.

Further features and advantages of the invention will be apparent from the detailed description hereinbelow set forth, together with the accompanying drawing.

BRIEF DESCRIPTION OF THE DRAWING

The single FIGURE is a graph of yield strength (in thousands of pounds per square inch) plotted against final annealing temperature (in degrees centigrade) for an illustrative example of an aluminum alloy sheet produced in accordance with the present invention.

DETAILED DESCRIPTION

The process of the present invention includes the step of strip-casting a slab of an aluminum alloy having the following composition (general and preferred ranges and limits):

| | Range, Maximum (max.) or Nominal (nom.) | |
|---|---|---|
| | General (%) | Preferred (%) |
| Mn | 1.3–2.3 | 1.5–1.8 |
| Fe | 0.5 max. | 0.1–0.3 |
| Si | 0.3 max. | 0.1 nom. |
| Mg | 0.5 max. | 0.2 max. |
| Cu | 0.5 max. | 0.2 max. |
| Zn | 2.0 max. | 2.0 max. |
| Zr | less than 0.1 | 0.03 max. |
| Cr | less than 0.1 | 0.03 max. |
| Ti | less than 0.1 | 0.03 max. |
| others (each/total) | 0.3/1.0 max. | 0.1/0.5 max. |
| Al | balance | balance |

In a specific example of a presently preferred embodiment of the invention, the alloy used contains 1.5–1.8% Mn, 0.1–0.3% Fe, about 0.1% Si, and less than 0.03% Mg.

The alloys employed in the invention can be considered Al-Mn alloys, in that the intermetallics formed in these alloys are predominantly Al-Mn intermetallics, and also in that manganese is the principal alloying element, with the possible exception (in some circumstances) of zinc, which does not, however, affect the formation of the intermetallics or materially affect the relevant mechanical properties.

The strip-casting step of the process of the invention involves continuously supplying an alloy of the specified composition, in molten state, to a type of casting equipment wherein there is cast a continuous strip or slab of the alloy having an as-cast gauge or thickness of not more than about 25 mm. A variety of such types of casting equipment are known. In some instances, i.e. in operations using some types of such equipment, the cast slab is subjected to hot rolling, while in other cases there is no hot reduction except for such as may occur in the caster itself incident to the casting operation.

It is at present especially preferred to perform the casting step in a twin-roll caster, owing in particular to the markedly superior uniformity of as-cast microstructure thereby achieved. When a twin-roll caster is used, a small amount of hot reduction of the slab occurs in the nip of the caster rolls, but apart from this inherent effect of the caster, the slab is not ordinarily subjected to any hot rolling prior to cold reduction. In the aforementioned exemplary embodiment of the invention, the casting step can be performed on a twin-roll caster of the specific type described above, manufactured by Hunter Engineering Company, to produce a continuous slab; as an illustrative specific example of dimensions, the slab can be 0.300 inch (about 7.62 mm.) thick and 56 inches wide.

After hot rolling (if any) and prior to any cold working, the workpiece is slab-annealed in accordance with the invention by heating at a temperature in the range of about 450° to about 550° C. (preferably about 500°–550° C.) for a period of about one to about twenty-four hours (preferably about two to about six hours) to precipitate most of the manganese of the alloy in manganese-rich intermetallic particles having an average particle size between about 0.1 and about 2 microns (typically about 0.5 micron); in the case of slab cast on a twin-roll caster, wherein there is no hot reduction subsequent to the casting step, the slab is subjected to the slab-annealing operation in as-cast conditions. This heating step may be performed with equipment conventional for heating strip-cast slab. In the aforementioned specific example of the presently preferred embodiment of the invention referred to above, the slab-annealing step is performed by heating the slab at 500° C. for a period of two to four hours.

After the slab-annealing step, and without any intervening hot working, the workpiece (i.e. in slab-annealed condition) is cold rolled in conventional manner to effect an initial substantial reduction of at least about 30% in its thickness. This initial cold rolling stage, in the aforementioned specific example of the presently preferred embodiment of the invention, is performed to reduce the workpiece from the as-cast slab thickness of 0.300 inch to a thickness of 0.030 inch, i.e. to effect a 90% cold reduction.

Following this initial cold rolling stage, the workpiece is interannealed by heating it at a temperature, in a range between about 250° and about 450° C., under conditions of time and temperature for reducing the amount of manganese in solid solution in the aluminum matrix to not more than about 0.2% of the weight of the matrix, while maintaining the workpiece substantially free of recrystallization, i.e. such that the interannealed workpiece contains not more than about 20% by volume of recrystallized grains.

In further explanation of the interannealing step, reference may be made to the "recrystallization temperature," by which is meant herein the maximum temperature at which a workpiece can be heated for a specified time while remaining substantially free of recrystallization. Stated generally, the interannealing step of the present process is performed by heating the workpiece to a temperature (within the aforementioned range) which is below the recrystallization temperature for that workpiece for the particular interannealing time selected. It will be appreciated that, for a given workpiece, the recrystallization temperature is time-dependent; i.e., within broad limits, the shorter the interannealing time, the higher the recrystallization temperature. Again, for a given interannealing time, the recrystallization temperature is dependent on the alloy composition and also on the prior treatment (especially the conditions of the slab-annealing operation) of the particular workpiece to be interannealed. Thus, for interannealing times of e.g. about two hours, temperatures in the upper portion of the above-stated numerical range (e.g. around 425° C.) for the interannealing step may be above the recrystallization temperature of some workpieces, especially those which have been slab-annealed at temperatures substantially above 500° C. or which have a relatively high content of iron (within the stated composition limits), but in the case of some workpieces having a high manganese content and a low iron content within the stated ranges, recrystallization does not occur upon heating for two hours at 425° C. The recrystallization temperature for any workpiece (and for a given, preselected heating time) is readily determinable with certainty by one having ordinary skill in the art, and once the recrystallization temperature has been thus determined, an interannealing temperature is selected which is below that recrystallization temperature but within the above numerical range.

The interannealing step of the invention can be performed in any convenient way, for example as a fast, continuous anneal, or as a batch anneal. In the aforementioned specific example of the presently preferred embodiment of the invention, the interannealing step is performed as a batch anneal by heating at a temperature between 300° and 350° C. for about two hours.

The interannealing step of the invention is followed by a further cold rolling stage, to reduce the workpiece (again, by at least about 30%) to the desired final sheet gauge. In the specific example of the presently preferred embodiment of the invention referred to above, this cold rolling operation reduces the workpiece from 0.030 inch to a final gauge of 0.004 inch, i.e. a cold reduction of about 87%.

The resultant sheet, at the final gauge, is then subjected to a final partial or full anneal, typically at a temperature between about 250° and about 400° C. for a period of about two hours. In the aforementioned specific example of the presently preferred embodiment of the invention, this step is performed as a final partial anneal, by heating the sheet at a temperature between 300° and 350° C. for two hours.

The product of the invention, produced as described above, has a fine grain or subgrain size and is a formable sheet (with Al-Mn intermetallic particles having an average particle size between about 0.1 and about two microns) having a controlled partial-anneal response (i.e. a high recrystallization temperature) and a shallow (low-slope) curve of yield strength as plotted against annealing temperature, thereby achieving a good combination of yield strength and ductility. The process of the invention can be practiced to produce sheet having a combination of strength and formability essentially equivalent to commonly used foil alloys such as those identified by the Aluminum Association designations AA 3003-0 and AA 5005-0 (the suffix 0 denoting temper) produced from conventional thick D.C. ingot by successive hot and cold rolling operations. It is also possible, for example by performing the final anneal at a lower temperature, to achieve sheet having a higher yield strength than the conventional alloys just mentioned, with very little sacrifice in formability. Sheet products of the invention have been found to be very satisfactory for the manufacture of rigid foil containers and deep-drawn cooking utensils.

Performance of the abovedescribed nonrecrystallizing interannealing step between successive stages of cold rolling is essential for production of a fine grain fully annealed sheet (i.e. when the final anneal is to be a full anneal) capable of use (for example) in substitution for AA 3003 annealed sheet. Interannealing is also necessary when the workpiece is to be reduced to foil gauges, and again, for attainment of the beneficial result of the invention the interanneal must be performed under nonrecrystallizing conditions. In the case of sheet products where the reduction is less severe, and which are to be given only a partial final anneal, such as interannealing step between successive cold rolling stages tends to improve the product especially by enhancing ductility. Nevertheless, the interannealed workpiece (i.e. without the subsequent cold rolling and final annealing steps) itself constitutes a useful product for various purposes. Thus, a usable sheet product can be made by performing the successive steps of strip casting, slab annealing, cold working (to a desired final gauge) and "interannealing," all in accordance with the invention as described above, but omitting the operations of cold rolling and final annealing after interannealing; in such case, the "interanneal" is in effect a final partial anneal of the cold-rolled product sheet.

The term "average particle size," as used herein, refers to the average particle diameter as determined, for example, by the procedure set forth in U.S. Pat. No. 3,989,548.

By way of further illustration of the invention, reference may be had to the following specific examples:

EXAMPLE I

An Al-Mn alloy containing 1.7% Mn, 0.2% Fe, 0.1% Si, and 0.03% Ti (grain refiner) was cast as 0.3-inch-thick slab on a twin-roll caster manufactured by Hunter Engineering Company. Separate coils of the as-cast slab were slab annealed by heating, then cold rolled from the 0.3 inch as-cast thickness to 0.03 inch, interannealed, further cold rolled to a final foil gauge of 0.0035 inch, and finally annealed. The thermal treatments (slab annealing, interannealing, and final annealing) were varied from coil to coil, but were all performed in accordance with the process of the invention, to provide a total of four coils (A-1, A-2, B-1 and B-2) representing sheet products of the invention produced with the differing specific combinations of thermal treatments specified in Table I below:

TABLE I

| | Temperature (°C.) and Time | | |
|---|---|---|---|
| Coil | Slab Annealing | Interannealing | Final Annealing |
| A-1 | 500° (2 hr.) | 400° (2 hr.) | 300° (2 hr.) |
| A-2 | 500° (2 hr.) | 400° (2 hr.) | 400° (2 hr.) |
| B-1 | 525°(6 hr.) | 350° (2 hr.) | 300° (2 hr.) |
| B-2 | 525° (6 hr.) | 350° (2 hr.) | 400° (2 hr.) |

Upon examination, it was found that the grain or subgrain size of the sheet thus produced was less than 25 microns and that the average particle size of the intermetallics was less than two microns. Sheet from all four coils was formed into rigid foil containers, using production dies, with no difficulty.

Properties of the four coils A-1, A-2, B-1 and B-2 produced in accordance with the invention, and properties of a coil (coil C) produced by casting a slab of a conventional alloy (AA 5005) on a twin-belt caster at a gauge of ¾ inch and then cold rolling from slab to sheet with rolling and thermal treatments parallel to those of the coils produced in accordance with the invention, are set forth in the following Table II:

TABLE II

| Coil | Orientation[1] | Ultimate Tensile Strength (psi × 1000) | Yield Strength (psi × 1000) | Elongation (%) | Erichsen[2] (in.) |
|---|---|---|---|---|---|
| A-1 | L | 19.6 | 14.0 | 14 | .28 |
| | T | 19.7 | 14.4 | 22 | |
| | 45 | 17.6 | 13.2 | 17 | |
| B-1 | L | 19.8 | 12.4 | 17 | .28 |
| | T | 19.1 | 12.8 | 17 | |
| | 45 | 17.1 | 12.3 | 22 | |
| C-1[3] | L | 16.2 | 9.9 | 7 | .16 |
| | T | 15.5 | 8.3 | 8 | |

TABLE II-continued

| Coil | Orientation[1] | Ultimate Tensile Strength (psi × 1000) | Yield Strength (psi × 1000) | Elongation (%) | Erichsen[2] (in.) |
|---|---|---|---|---|---|
| | 45 | 15.8 | 8.6 | 10 | |
| A-2 | L | 17.7 | 7.2 | 18 | .30 |
| | T | 17.3 | 7.1 | 24 | |
| | 45 | 15.8 | 6.9 | 26 | |
| B-2 | L | 18.0 | 6.9 | 20 | .29 |
| | T | 17.6 | 6.9 | 23 | |
| | 45 | 16.2 | 7.1 | 22 | |
| C-2[4] | L | 13.2 | 4.5 | 12 | .23 |
| | T | 13.6 | 4.8 | 14 | |
| | 45 | 13.1 | 6.2 | 13 | |

[1]L = longitudinal, T = transverse, 45 = 45°
[2]A cupping test in which a piece of sheet metal, restrained except at the center, is deformed by a cone-shaped spherical-end plunger until fracture occurs. The height of the cup in millimeters (or inches) at fracture is a measure of the ductility. The test is described in the British Standards Institute B.X. 3855: 1965: entitled "Method for Modified Erichsen Cupping Test for Sheet and Strip Metal."
[3]Sample of coil C given a final anneal at 300° C. for two hours.
[4]Sample of coil C given a final anneal at 400° C. for two hours.

The FIGURE of the drawing is a graph on which average yield strength is plotted against annealing temperature for the alloy represented by coil B with the values set forth in Table II above averaged and with values obtained for other annealing temperatures. This graph illustrates a shallow (low-slope) curve for yield strength plotted against annealing temperature characteristic of sheet produced in accordance with the invention.

EXAMPLE II

Slabs 0.295 inch thick of alloys having the following compositions were cast using a twin-roll caster:

| | Alloy D | Alloy E |
|---|---|---|
| Fe | 0.20% | 0.30% |
| Mn | 1.64 | 1.47 |
| Si | 0.10 | 0.08 |
| others (each) | less than 0.03 | less than 0.03 |
| Al | balance | balance |

Each slab was slab annealed for two hours at 500° C., cold rolled from 0.295 inch to 0.150 inch, subjected to a nonrecrystallizing interanneal by heating at 400° C. for two hours, again cold rolled from 0.150 inch to 0.080 inch, and given a final partial anneal at 400° C. for two hours. Properties of the produced sheet are set forth in Table III.

TABLE III

| Alloy | Orientation | Ultimate Tensile Strength (psi × 1000) | Yield Strength (psi × 1000) tion | Elongation (in.) | Erichsen |
|---|---|---|---|---|---|
| D | L | 20 | 14 | 22 | 0.46 |
| | T | 20 | 15 | 17 | |
| E | L | 19 | 12 | 25 | 0.47 |
| | T | 19 | 13 | 21 | |

It is to be understood that the invention is not limited to the features and embodiments hereinabove specifically set forth but may be carried out in other ways without departure from its spirit.

I claim:

1. A process for producing aluminum alloy sheet, comprising the successive steps of (a) strip casting a workpiece in slab form, having a thickness of not more than about 25 mm., of an aluminum alloy consisting essentially of 1.3–2.3% Mn, up to 0.5% each of Fe, Mg, and Cu, up to 0.3% Si, up to 2.0% Zn, less than 0.1% each of Zr, Cr, and Ti, other elements up to 0.3% each and up to 1.0% total, balance Al;

(b) slab annealing the workpiece by heating the workpiece for precipitating a major proportion of the Mn in intermetallic particles having an average particle size, at the completion of the slab annealing step, between about 0.1 and about two microns;

(c) initially cold rolling the workpiece in slab-annealed condition, for reducing its thickness;

(d) interannealing the workpiece by heating it for reducing the amount of Mn in solid solution in the aluminum matrix of the workpiece to not more than about 0.2% of the weight of the matrix while maintaining the workpiece substantially free of recrystallization, such that the workpiece upon completion of interannealing contains not more than about 20% by volume of recrystallized grains;

(e) further cold rolling the workpiece for additionally reducing its thickness to provide the workpiece in the form of sheet of desired final gauge; and (f) annealing the sheet, thereby producing a sheet having a fine grain or subgrain structure.

2. A process according to claim 1, wherein the step of slab annealing the workpiece comprises heating the workpiece at a temperature in the range between about 450° C. and about 550° C. for about one to about 24 hours.

3. A process according to claim 1, wherein the interannealing step comprises heating the workpiece for a predetermined period of time at a temperature, in the range between about 250° and about 450° C., which is below the recrystallization temperature of the workpiece for said predetermined period of time.

4. A process according to claim 1, wherein the casting step is performed by continuously casting the workpiece between chilled rolls.

5. A process according to claim 1, wherein the alloy consists essentially of 1.5–1.8% Mn, 0.1–0.3% Fe, about 0.1% Si, up to 0.2% each of Mg and Cu, up to 2.0% Zn, up to 0.03% each of Zr, Cr and Ti, other elements up to 0.1% each and up to 0.5% total, balance Al.

6. Aluminum alloy sheet produced by the process of claim 1.

7. A process for producing aluminum alloy sheet from a workpiece that has been strip cast in slab form and slab-annealed by heating to a temperature of between about 450° and about 550° C. for precipitating a major proportion of the Mn in intermetallic particles having an average particle size, after slab annealing, between about 0.1 and about two microns, said workpiece being constituted of an aluminum alloy consisting essentially of 1.3–2.3% Mn, up to 0.5% each of Fe, Mg, and Cu, up to 0.3% Si, up to 2.0% Zn, less than 0.1% each of Zr, Cr, and Ti, other elements up to 0.3% each and up to 1.0% total, balance Al, said workpiece as cast having a thickness of not more than about 25 mm., said process comprising:

(a) initially cold rolling the workpiece, in slab-annealed condition, for reducing its thickness;

(b) interannealing the workpiece by heating it to a temperature between about 250° and about 450° C. for reducing the amount of Mn in solid solution in the aluminum matrix of the workpiece to not more than about 0.2% of the weight of the matrix while maintaining the workpiece substantially free of recrystallization, such that the workpiece upon completion of interannealing contains not more than about 20% by volume of recrystallized grains;

(c) further cold rolling the workpiece for additionally reducing its thickness to provide the workpiece in the form of sheet of desired final gauge; and (d) annealing the sheet, thereby producing a sheet having a fine grain or subgrain structure.

8. A process for producing aluminum alloy sheet, comprising the successive steps of (a) strip casting a workpiece in slab form, having a thickness of not more than about 25 mm., of an aluminum alloy consisting essentially of 1.3–2.3% Mn, up to 0.5% each of Fe, Mg, and Cu, up to 0.3% Si, up to 2.0% Zn, less than 0.1% each of Zr, Cr, and Ti, other elements up to 0.3% each and up to 1.0% total, balance Al;

(b) slab annealing the workpiece by heating the workpiece for precipitating a major proportion of the Mn in intermetallic particles having an average particle size, at the end of the slab annealing step, between about 0.1 and about two microns;

(c) cold rolling the workpiece, in slab-annealed condition, for reducing its thickness; and (d) annealing the workpiece by heating it for reducing the amount of Mn in solid solution in the aluminum matrix of the workpiece to not more than about 0.2% of the weight of the matrix while maintaining the workpiece substantially free of recrystallization, such that the workpiece upon completion of annealing contains not more than about 20% by volume of recrystallized grains.

9. Aluminum alloy sheet produced by the process of claim 8.

* * * * *

UNITED STATES PATENT AND TRADEMARK OFFICE

CERTIFICATE OF CORRECTION

PATENT NO. : 4,334,935

DATED : June 15, 1982

INVENTOR(S) : Larry R. Morris

It is certified that error appears in the above-identified patent and that said Letters Patent are hereby corrected as shown below:

Col. 6, line 61, "(psl" should read --(psi-- .

Col. 7, line 5, "(psl" should read --(psi-- ;

line 54, "Elonga-
(in.)" should read --Elonga-
tion-- .

Signed and Sealed this

*Twenty-fifth* Day of *January 1983*

[SEAL]

*Attest:*

GERALD J. MOSSINGHOFF

*Attesting Officer*

*Commissioner of Patents and Trademarks*